US009705178B2

(12) United States Patent
Liu et al.

(10) Patent No.: US 9,705,178 B2
(45) Date of Patent: Jul. 11, 2017

(54) ULTRA HIGH FREQUENCY TAG AERIAL BASED ON FRACTAL PROCESSING

(71) Applicant: Zhijia Liu, Shanghai (CN)

(72) Inventors: Zhijia Liu, Shanghai (CN); Guohong Du, Chengdu (CN)

(73) Assignee: Zhijia Liu, Shanghai (CN)

( * ) Notice: Subject to any disclaimer, the term of this patent is extended or adjusted under 35 U.S.C. 154(b) by 313 days.

(21) Appl. No.: 14/389,084

(22) PCT Filed: Mar. 29, 2013

(86) PCT No.: PCT/CN2013/073409
§ 371 (c)(1),
(2) Date: Dec. 30, 2014

(87) PCT Pub. No.: WO2013/143485
PCT Pub. Date: Oct. 3, 2013

(65) Prior Publication Data

US 2016/0372816 A1 Dec. 22, 2016

(30) Foreign Application Priority Data

Mar. 30, 2012 (CN) ..... 2012 1 0090310

(51) Int. Cl.
*H01Q 1/36* (2006.01)
*H01Q 1/22* (2006.01)

(52) U.S. Cl.
CPC ..... *H01Q 1/2208* (2013.01); *H01Q 1/36* (2013.01)

(58) Field of Classification Search
CPC ..... H01Q 1/38; H01Q 1/36; H01Q 1/2208
See application file for complete search history.

(56) References Cited

U.S. PATENT DOCUMENTS

2004/0017317 A1* 1/2004 Schmiade ..... H01Q 1/36 343/700 MS
2007/0171071 A1* 7/2007 Chiu ..... H01Q 1/2208 340/572.7
2008/0001838 A1* 1/2008 Huang ..... H01Q 9/285 343/795

FOREIGN PATENT DOCUMENTS

CN 2651948 Y 10/2004
CN 101110494 A 1/2008
CN 201966324 U 9/2011
CN 202513279 U 10/2012

* cited by examiner

*Primary Examiner* — Dieu H Duong
(74) *Attorney, Agent, or Firm* — Scully Scott Murphy & Presser

(57) ABSTRACT

The present disclosure relates to an ultrahigh frequency tag antenna based on fractal processing comprising a substrate (2), a radiation plate (3) and a substrate base plate (4). The radiation plate (3) has a first radiation oscillator unit (31) and a second radiation oscillator unit (32). A chip (33) is coupled between the first radiation oscillator unit (31) and the second radiation oscillator unit (32). Each of the first radiation oscillator unit (31) and the second radiation oscillator unit (32) has a fractal structure.

8 Claims, 1 Drawing Sheet

ULTRA HIGH FREQUENCY TAG AERIAL BASED ON FRACTAL PROCESSING

CROSS-REFERENCE TO RELATED APPLICATIONS

This application is an U.S. national phase application of International Application No. PCT/CN2013/073409, filed on Mar. 29, 2013, which is based upon and claims priority to Chinese Patent Application No. 201210090310.8, filed on Mar. 30, 2012, the entire contents of which are incorporated herein by reference.

TECHNICAL FIELD

The present disclosure relates to a tag antenna, and more particularly, to an ultrahigh frequency tag antenna based on fractal processing.

BACKGROUND

With development and population of the RFID (Radio Frequency Identification) technique, RFID, served as a basis for a fast, real-time and accurate information acquisition and processing in high tech and standardization of messages, has been known across the world as one of top ten most significant techniques in this century. Because of gradual maturity of the standardization of the UHF frequency band in China, and requirements in applications such as logistics, smart transport and digital tourism, demands for track management of metal and non-metal assets in various fields have become increasingly clear, such as ultra-thin, ultra-small and ultra-light tag design, which put forward higher requirements for design of tag antennas.

With the development of the tag antenna technique, a micro-strip antenna with the following advantages has been presented: it has a low profile, a light weight and a low cost; it is able to be conformal with various carriers; it is suitable for mass production with printed circuit board technology; and it is easy to implement circular polarization, dual-polarization and dual-band operation, and so on; however, geometric shapes of conventional tag antennas are designed based on Euclidean geometry, and thus the minimum size that conventional tag antennas may be achieved remains limited.

SUMMARY

The present disclosure provides an ultrahigh frequency tag antenna based on fractal processing including a substrate, a radiation plate and a base plate. The radiation plate includes a first radiation oscillator unit and a second radiation oscillator unit. A chip is coupled between the first radiation oscillator unit and the second radiation oscillator unit. Each of the first radiation oscillator unit and the second radiation oscillator unit includes a fractal structure.

DETAILED DESCRIPTION

Hereinafter, the specific embodiments of the present disclosure are described in detail with reference to the accompany drawings.

Figure 1:
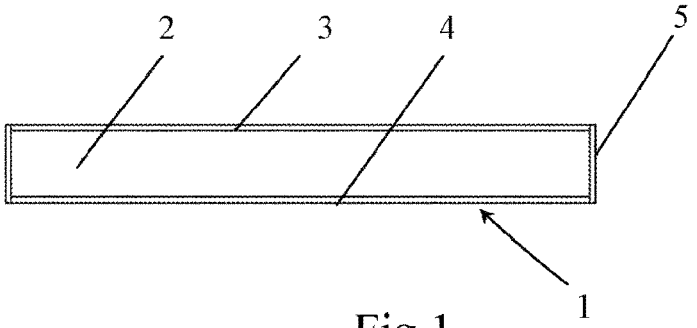
FIG. 1 shows an ultrahigh frequency tag antenna based on fractal processing of the present disclosure.
Figure 2:
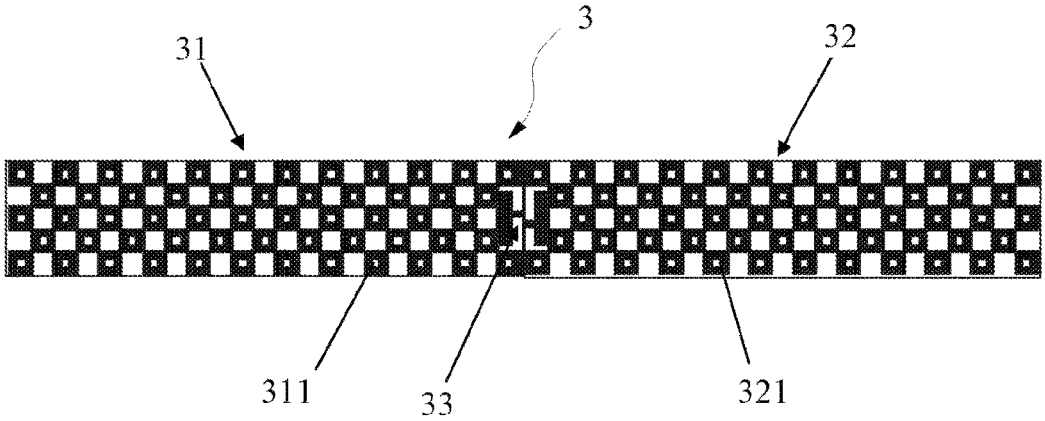
FIG. 2 is a schematic view showing a radiation plate of the present disclosure.

Referring to FIG. 1 and FIG. 2, an ultrahigh frequency tag antenna 1 based on fractal processing of the present disclosure has a substrate 2, and a radiation plate 3 attached to an upper surface of the substrate and a substrate base plate 4 attached to a lower surface of the substrate, the substrate 2 has a short circuit surface 5 on each side thereof. The radiation plate 3 of the ultrahigh frequency tag antenna 1 based on fractal processing of the present disclosure has two amplitude oscillator units 31 and 32. A chip 33 is disposed between the amplitude oscillator units 31 and 32. The amplitude oscillator units 31 and 32 are processed through the symmetrical fractal processing, and the space filling ability in the fractal theory is utilized so that a resonant frequency of the tag antenna is lowered and a size of the tag antenna is reduced.

With respect to the radiation plate 3 of the ultrahigh frequency tag antenna 1 based on fractal processing of the present disclosure, the radiation plate 3 is formed in the following manner: by utilizing the space filling and self-similarity abilities in the fractal theory, a radiation oscillator unit 31 having an array of radiation elements 311 is formed by calculating fractal dimension of a single rectangular oscillator and periodically and repeatedly overlapping square fractal units; and another radiation oscillator unit 32 disposed symmetrically to the radiation oscillator unit 31 of the radiation plate 3 is formed through a similar fractal and periodical and repeated overlapping process, so as to simultaneously form the radiation plate 3 of a micro-strip antenna with a fractal binary array. Resonance is produced between the radiation elements 311 of the ultrahigh frequency tag antenna 1 based on fractal processing and is produced between the two amplitude oscillator units 31, 32, so that the resonant frequency of the tag antenna is lowered, and a size of the tag antenna is also reduced.

Figure 3:
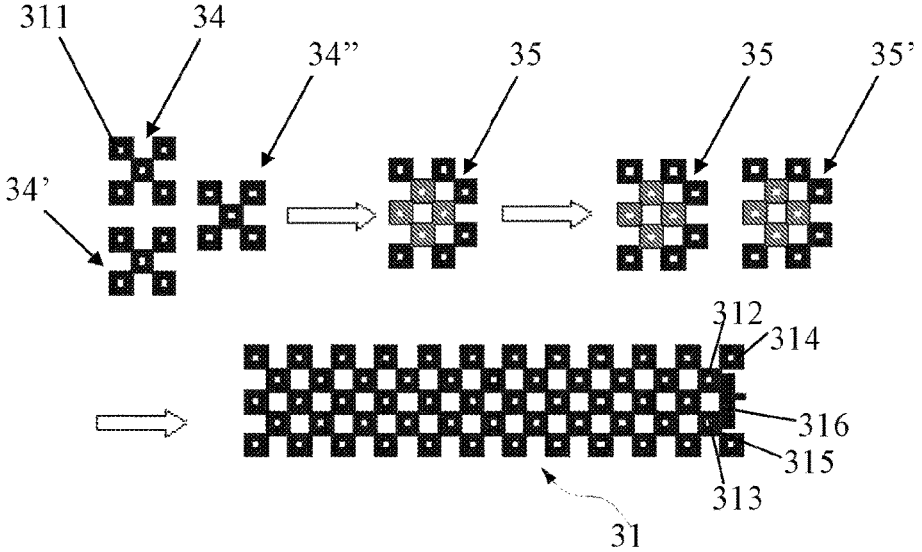
FIG. 3 is a schematic view showing a process of forming a radiation oscillator unit of a fractal structure of the present disclosure.

Hereinafter, a process of forming a fractal structure of the present disclosure is described in detail with reference to FIG. 3. Here, an ordinary non-fractal tag antenna with an area of 65 mm*7.1 mm and a resonant frequency of 1250 MHz is taken as an example to explain a process of forming a radiation plate with the same area.

Firstly, an area of fractal unit and the number of fractal processing are determined A square region of 4.3 mm*4.3 mm is selected, and then is equally divided into 9 parts, then 4 parts thereof are etched to form a square fractal region 34 having radiation elements 311. Adjacent radiation elements 311 inside the square fractal region 34 are communicated with each other. An area of a passage communicated between adjacent radiation elements 311 is decided by changing a size of the etched area of the equally divided 4 parts during the etching process. Also, a resistance and a gain of the tag antenna 10 are changed by changing the area of the passage communicated between adjacent radiation elements 311.

Next, the square fractal region 34 is copied, and same regions at an adjacent side of the square fractal region 34 being copied and the copied square fractal region 34' or 34"are overlapped, so as to form a pattern of the overlapped region 35 as shown in FOG. 3. The pattern of the overlapped region 35 formed by the overlapping is copied sequentially in a transverse direction, and regions having a same pattern of radiation elements 311 of two adjacent overlapped regions 35 and 35' are overlapped; by that analogy, until a last region is overlapped, two radiation elements 312 and 313 at end of a first radiation oscillator unit 31 are connected with a connection feed line 316 and coupled to the chip 33 at a part. Meanwhile, radiation elements 314 and 315 are filled in a space outside of the radiation elements 312 and 311 and the connection feed line 316 with respect to the first radiation oscillator 31, so as to form the first radiation oscillator unit 31 having a fractal structure.

Here, the filled radiation elements 314 and 315 are not radiation elements formed by repeatedly overlapping, but are radiation elements having the same structure as that of the radiation element 311 of the first radiation oscillator unit 31 which are filled in the periphery of the connection feed line 316 and the blank space of the first radiation oscillator unit 31, and the function thereof is to effectively expand the space filling ability of the tag antennas. A chip 22 and the first radiation oscillator unit 31 are coupled with the connection feed line 316, mainly in order to increase impedance matching degree of the tag antenna 1, to optimize performance of the tag antenna. A second radiation oscillator unit 32 disposed symmetrically to the first radiation oscillator unit 31 is obtained through a similar manner.

During determining of the area and the number of fractal processing of the fractal units, a final gain of the tag antenna needs to be considered. If the number of fractal processing is too large, the limited radiation area of the antenna itself will be reduced, so that the gain of the antenna will be significantly reduced. A minimum fractal area and a minimum number of fractal processing may be adjusted depending on a specific design and size, to select a fractal unit and repeated number being suitable for the structure of the antenna. In the exemplary fractal processing, on a radiation plate with an area of 65 mm*7.1 mm, a fractal area of 4.3 mm*4.3 mm is selected, and the fractal processing with 9 equal parts is performed on the square fractal region.

In another embodiment of the present disclosure, in order to improve the effect of fractal processing, a secondary fractal processing may be performed on the basis of the fractal processing performed on the square fractal region 34 of the present embodiment, the radiation element 311 is fractal processed, of which the principle is similar to the fractal processing performed on the square fractal region 34. A difference lies in that a center region of the fractal structure is etched during the fractal processing of the radiation element 311 to form a structure of the radiation element 311 as shown in FIG. 2 and FIG. 3. The subsequent copy and overlap processing of the square fractal region 34 of the radiation element 311 having a hollow central region is similar to those in the above embodiment, the description thereof will not be repeatedly. Compared with the tag antenna 10 having radiation elements 311 without a hollow central structure, the tag antenna 10 having radiation elements 311 with a hollow central structure may further lower the resonance frequency of the antenna and further reduce the size of the antenna.

In the above embodiments, the square fractal unit is only taken as an example to explain the structure of the radiation plate 3 of the ultrahigh frequency tag antenna 1 based on fractal processing, and not intended to limit the structures of the radiation oscillator units 31 and 32 of the present disclosure. The fractal pattern of the radiation elements 311 in the radiation oscillator units 31 and 32 of the present disclosure may also be regular shapes such as a square shape, a triangular shape, a rectangular shape, a rhombic shape, a circular shape or other irregular shapes.

The ultrahigh frequency tag antenna 1 based on fractal processing of the present disclosure has a short circuit structure configured to connect the radiation plate 3 and the substrate base plate 4. The short circuit structure may be formed by forming a conductive through hole on the substrate 2, or by forming a short circuit surface 5 on both sides of the substrate 2. The above is only description of the location and manner of the formed short circuit structure of the ultrahigh frequency tag antenna 1 based on fractal processing of the present disclosure, and the short circuit surface 5 of the ultrahigh frequency tag antenna 1 based on fractal processing of the present disclosure is not a necessary structure to implement the present disclosure. However, the size of the ultrahigh frequency tag antenna 1 based on fractal processing which has a short circuit structure may be significantly reduced compared with the size of the ultrahigh frequency tag antenna 1 based on fractal processing without a short circuit structure.

Hereinafter, beneficial effects of the ultrahigh frequency tag antenna 1 based on fractal processing of the present disclosure are explained with reference to experimental data of Table 1.

TABLE 1

| two cases | resonance frequency f (MHz) | −10 dB band width (MHz) | relative band width | gain G (dB) |
|---|---|---|---|---|
| without fractal processing | 1250 | 135 | 10.8% | −12.3 |
| with fractal processing | 910 | 168 | 18.5% | −14.3 |

Table shows results respectively from tests of two tag antennas with the same radiation units, the case without fractal processing of which represents an ordinary tag antenna, and the case with fractal processing of which represents the ultrahigh frequency tag antenna 1 based on fractal processing of the present disclosure. It can be seen from the data in Table 1 that a resonant frequency of the ultrahigh frequency tag antenna 1 based on fractal processing of the present disclosure is significantly lower than that of a metal tag antenna without fractal processing.

As well known in the art, a relationship between a radiation frequency and a wave length is as represented as Formula (1):

$$\lambda = \frac{C}{f\sqrt{\varepsilon_r}} \qquad \text{Formula (1)}$$

where C is the speed of light, $\epsilon_r$ is a relative permittivity, f is a resonant frequency, and $\lambda$ is a wavelength.

As can be seen from Formula (1), the resonant frequency f is inversely proportional to the wavelength $\lambda$, and these two parameters are all relevant to the size of the radiation unit of the tag antenna. According to a design principle of tag antennas, the size of the tag antenna should be ¼ or ½ of the wave length. With decreasing of the frequency f, the wavelength $\lambda$, is increased accordingly, and thus the designed size of the tag antenna is also increased. According to Table 1, the resonant frequency f of the tag antenna without fractal processing is 1250 MHz, and the resonant frequency f of the ultrahigh frequency tag antenna 1 based on fractal processing of the present disclosure is 910 MHz. It can be seen by introducing these data into Formula (1) that the size of the tag antenna without fractal processing will be significantly increased if the tag antenna without fractal processing is at the same resonant frequency, such as 910 MHz as shown in the Table; and the ultrahigh frequency tag antenna 1 based on fractal processing of the present disclosure advantageously has a size significantly smaller than the ordinary tag antenna while realizing the same resonant frequency, and its area may be 70% of that of the ordinary tag antenna.

It can be seen from the data in Table 1, the relative band width of the ultrahigh frequency tag antenna 1 based on fractal processing of the present disclosure is 18.5%, and the relative band width of the ordinary tag antenna is 10.8%. As well known to those skilled in the art, the relative band width represents a ratio of the band width of a central frequency. Under a same condition, the more is the relative band width, the wider is a compatible frequency range of the tag antenna. Therefore, compared with the ordinary tag antenna, the ultrahigh frequency tag antenna 1 based on fractal processing of the present disclosure has a wider frequency range.

Finally, the gain G of the ultrahigh frequency tag antenna 1 based on fractal processing of the present disclosure is −14.3 dB, and is significantly increased compared with the gain G of −12.3 dB of the ordinary antenna without fractal processing. The data in the table are gains of the radiation units with the same size; however, under the same resonant frequency f, the gain G of the ultrahigh frequency tag antenna 1 based on fractal processing of the present disclosure will be even more significantly increased. A readable range r of a tag antenna is generally determined according to Formula (2):

$$r_{max}\sqrt{\frac{EIRP\cdot G_{tag}\cdot\lambda^2}{(4\pi)^2\cdot P_{min}}\cdot\eta} \qquad \text{Formula (2)}$$

where $r_{max}$ is a maximum readable range, EIRP is an equivalent isotropic radiated power, $G_{tag}$ is a gain of a tag antenna, $\lambda$ is a wavelength of an electromagnetic wave in vacuum, $\eta$ is a loss factor, and $P_{min}$ is a sensitivity of a tag chip. Thus, the more is the gain of the antenna, the larger is the readable range.

As shown in the above table, the gain of the ultrahigh frequency tag antenna 1 based on fractal processing of the present disclosure is increased by 2 dB compared with the ordinary tag antenna without fractal processing. It can be seen from Formula (2) that the readable range is improved by 6%. As described in the above, the above results are due to the difference between the resonant frequencies of the two tag antennas. If the resonant frequency of the ordinary tag antenna without fractal processing is lowered to 910 MHz by other manners (for example, by increasing a length of the antenna through grooving) or is directly lowered to 910 MHz, the gain thereof will be lowered by 4 dB to 5 dB. The readable range of the ultrahigh frequency tag antenna 1 based on fractal processing of the present disclosure will be improved by 70%, compared with the ordinary tag antenna without fractal processing with the same resonant frequency. It can be seen form the above that the ultrahigh frequency tag antenna 1 based on fractal processing of the present disclosure may sufficiently ensure the readable range of the tag antenna while well ensure to lower the resonant frequency and to reduce the size of the antenna.

Based on the above discussed improvement, the ultrahigh frequency tag antenna 1 based on fractal processing of the present disclosure solves the current problem of miniaturization of tag antennas. By employing fractal theory in UHF frequency anti-mental tag antenna, the size of the tag antenna may be further miniaturized without affecting the readability of the tag antenna; therefore, the tag antenna may be realized as more integral with the environment and more conceal, and may be provided on portable electronic products, portable devices or other similar items that need to be identified in a form of a tag, a data plate or other accessories, which realizes identification function of the tag antenna without damaging the outer appearance of the asset attached with it.

The above is merely a description and drawings of the preferred embodiments of the present disclosure. The features of the present disclosure are not limited thereto. All the embodiments in consistent with the spirit of the claims of the present disclosure and other similar variations will be covered by the present disclosure. The obvious variations and modifications by those skilled in the art fall into the protection scope of the claims of the present disclosure.

What is claimed is:

1. An ultrahigh frequency tag antenna based on fractal processing, comprising:

a substrate, a radiation plate, and a base plate, wherein the radiation plate comprises a first radiation oscillator unit and a second radiation oscillator unit, a chip is coupled between the first radiation oscillator unit and the second radiation oscillator unit, and each of the first radiation oscillator unit and the second radiation oscillator unit comprises a fractal structure, wherein the fractal structure is formed from a square fractal region on which fractal processing, copying and overlapping are performed, the fractal structure has a square pattern of radiation elements, the pattern of radiation elements are square which is formed by equally dividing a selected region by 9 parts, and the square radiation elements are processed with a secondary fractal processing to provide a hollow center structure the square radiation elements.

2. The tag antenna according to claim 1, wherein the first radiation oscillator unit and the second radiation oscillator unit are symmetrically distributed.

3. The tag antenna according to claim 1, wherein a fractal processing of the square fractal region is as follows:

a square region is equally divided by 9 parts, and 4 parts thereof are etched to form a square fractal region having the square radiation elements.

4. The tag antenna according to claim 3, wherein the square fractal region is copied, regions with a same region pattern at an adjacent side of the square fractal region and adjacent square fractal region are overlapped, so as to form an overlapped region.

5. The tag antenna according to claim 4, wherein the overlapped region formed by overlapping is copied sequentially in a transverse direction, and regions having a same pattern of radiation elements of two adjacent overlapped regions are overlapped, to form the first radiation oscillator unit having a fracture structure and the second radiation oscillator unit having a fracture structure.

6. The tag antenna according to claim 1, wherein the tag antenna further comprises:

a short circuit structure configured to be a short circuit surface disposed at both sides of the substrate or be a conductive through hole on the substrate.

7. The tag antenna according to claim 1, wherein the square fractal region is copied, regions with a same region pattern at an adjacent side of the square fractal region and adjacent square fractal region are overlapped, so as to form an overlapped region.

8. The tag antenna according to claim 7, wherein the overlapped region formed by overlapping is copied sequentially in a transverse direction, and regions having a same pattern of radiation elements of two adjacent overlapped regions are overlapped, to form the first radiation oscillator unit having a fracture structure and the second radiation oscillator unit having a fracture structure.

* * * * *